US009267266B2

(12) United States Patent
Cutler et al.

(10) Patent No.: US 9,267,266 B2
(45) Date of Patent: Feb. 23, 2016

(54) LOCAL DUST EXTRACTION SYSTEM FOR AN EXCAVATION MACHINE

(75) Inventors: Edward Lee Cutler, Bloomfield, IA (US); Glenn Meinders, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 14/111,436

(22) PCT Filed: Apr. 13, 2012

(86) PCT No.: PCT/US2012/033570

§ 371 (c)(1),
(2), (4) Date: Oct. 11, 2013

(87) PCT Pub. No.: WO2012/142446

PCT Pub. Date: Oct. 18, 2012

(65) Prior Publication Data

US 2014/0048635 A1 Feb. 20, 2014

Related U.S. Application Data

(60) Provisional application No. 61/475,585, filed on Apr. 14, 2011.

(51) Int. Cl.
*E21C 35/22* (2006.01)
*E21F 5/20* (2006.01)
(Continued)

(52) U.S. Cl.
CPC . *E02F 5/30* (2013.01); *E02F 3/962* (2013.01); *E02F 5/08* (2013.01); *E02F 9/00* (2013.01); *E21C 35/223* (2013.01); *E21F 5/20* (2013.01); *E01C 2301/50* (2013.01)

(58) Field of Classification Search
CPC ... E21C 35/22; E21C 35/223; E21C 2301/50; E21F 5/20
See application file for complete search history.

(56) References Cited

U.S. PATENT DOCUMENTS 2,100,178 A * 11/1937 White ..... 299/68
3,646,728 A * 3/1972 Holler, Jr. ..... 96/228
(Continued)

FOREIGN PATENT DOCUMENTS

JP 2001-323499 A 11/2001
JP 2010-052675 A 3/2010
(Continued)

OTHER PUBLICATIONS

International Search Report for corresponding International Patent Application No. PCT/US2012/033570 mailed Oct. 29, 2012.
(Continued)

*Primary Examiner* — David Bagnell
*Assistant Examiner* — Michael Goodwin
(74) *Attorney, Agent, or Firm* — Merchant & Gould P.C.

(57) ABSTRACT

The present disclosure relates to an air cleaning system for an off-road excavation apparatus. The off-road excavation apparatus includes an excavating component and a shroud assembly that at least partially covers the excavating component. The shroud assembly includes a first shroud component and a second shroud component. The first shroud component is moveable relative to the second shroud component to allow access to the excavating component. The air cleaning system draws air from inside the shroud assembly and includes an air cleaner, an air conduit and an air moving device that are all carried by the first shroud component as the first shroud component is moved relative to the second shroud component.

16 Claims, 14 Drawing Sheets

(51) Int. Cl.

| | |
|---|---|
| ***E02F 5/30*** | (2006.01) |
| ***E02F 3/96*** | (2006.01) |
| ***E02F 5/08*** | (2006.01) |
| ***E02F 9/00*** | (2006.01) |

(56) References Cited

U.S. PATENT DOCUMENTS

| | | | | |
|---|---|---|---|---|
| 5,063,713 | A * | 11/1991 | Buchheit, Jr. | 451/344 |
| 5,590,041 | A | 12/1996 | Cooper | |
| 7,290,360 | B2 | 11/2007 | Unzicker et al. | |
| 2002/0012572 | A1 | 1/2002 | Bruso | |
| 2006/0182591 | A1 | 8/2006 | Hackett et al. | |
| 2007/0096539 | A1* | 5/2007 | Walker et al. | 299/39.3 |
| 2009/0070954 | A1 | 3/2009 | Torno | |
| 2013/0056233 | A1* | 3/2013 | Gift et al. | 172/123 |

FOREIGN PATENT DOCUMENTS

| | | | |
|---|---|---|---|
| WO | WO 2010/045952 | A1 | 4/2010 |
| WO | WO 2011/109024 | A1 | 9/2011 |

OTHER PUBLICATIONS

Colinet, J. et al. "Best Practices for Dust Control in Metal/Nonmetal Mining", Department of Health and Human Services, Centers for Disease Control and Prevention, NIOSH, May 2010, 83 pages.

European Search Report for Application No. 12771708.0 mailed Dec. 3, 2014.

* cited by examiner

LOCAL DUST EXTRACTION SYSTEM FOR AN EXCAVATION MACHINE

This application is a National Stage Application of PCT/US2012/033570, filed Apr. 13, 2012, which claims benefit of U.S. Provisional Patent Application Ser. No. 61/475,585, filed Apr. 14, 2011, and which applications are incorporated herein by reference. To the extent appropriate, a claim of priority is made to each of the above disclosed applications.

TECHNICAL FIELD

The present disclosure relates generally to dust suppression equipment.

BACKGROUND

Rock is an indefinite mixture/aggregate of naturally occurring materials that mainly include minerals. Rocks from which minerals or metals can be mined for economic purposes are called ores. Man-made materials having properties similar to rock include concrete and asphalt.

Certain machines allow rock or like materials to be excavated from the earth's surface. Examples of this type of excavation machine include surface excavation machines (e.g., surface mining machines), rock wheels and trenchers.

Surface excavation machines are used to level terrain and/or remove a layer of material from a given site location. Typical applications include surface mining, demolishing a road, and prepping a site for new construction or reconstruction. Example rocks that are excavated using surface excavation machines include limestone, gypsum, bauxcite, phosphate and iodide. Materials (e.g., ores) such as copper, iron, gold, diamonds and coal can also be excavated using surface excavation machines. Surface excavation machines provide an economical alternative to blasting and hammering. Furthermore, surface excavation machines provide the advantage of generating a consistent output material after a single pass. Therefore, surface excavation machines can reduce the need for primary crushers, large loaders, large haul trucks and the associated permits to transport materials to crushers.

A typical surface excavation machine includes a main chassis supporting an operator cab. The main chassis is supported on a ground drive system such as a plurality of tracks. An engine such as a diesel engine is mounted on the main chassis. The engine provides power for driving the various components of the machine. Often, the diesel engine powers a hydraulic system which includes various hydraulic motors and hydraulic cylinders included throughout the machine. An excavating tool is typically mounted at a rear end of the main chassis. The excavation tool can include a rotational excavating drum mounted on a pivotal boom. The excavating drum carries a plurality of cutting tools (e.g., carbide tipped teeth) suitable for cutting rock. An example surface excavation machine of the type described above is disclosed at U.S. Pat. No. 7,290,360, which is hereby incorporated by reference in its entirety.

Trenchers are used to excavate trenches in rock. Often, the trenches are excavated for the purpose of installing utilities/product such as electrical cable, fiber optic cable or pipe. A typical trencher can have the same basic components as a surface excavation machine, except the boom and excavating drum is replaced with a trenching attachment. The trenching attachment includes a boom on which a digging chain is rotatably mounted. Cutting tools suitable for cutting rock (e.g., carbide tipped teeth) are carried by the digging chain. An example surface excavation machine of the type described above is disclosed at U.S. Pat. No. 5,590,041, which is hereby incorporated by reference in its entirety.

Particularly in dry conditions, excavation machines of the type described above can generate large amounts of dust.

SUMMARY

The present disclosure relates generally to a local dust extraction system configured to reduce the amount of dust that a piece of heavy off-road excavation equipment discharges to atmosphere during excavation operations. In one embodiment, the local dust extraction system is adapted for use on a surface excavation machine such as a surface mining machine. The local dust extraction system is also applicable to other type of excavation equipment such as trenchers, rock wheels and vibratory plows.

These and other features and advantages will be apparent from reading the following detailed description and reviewing the associated drawings. It is to be understood that both the foregoing general description and the following detailed description are explanatory only and are not restrictive of the broad aspects of the disclosure.

DETAILED DESCRIPTION

Figure 1:
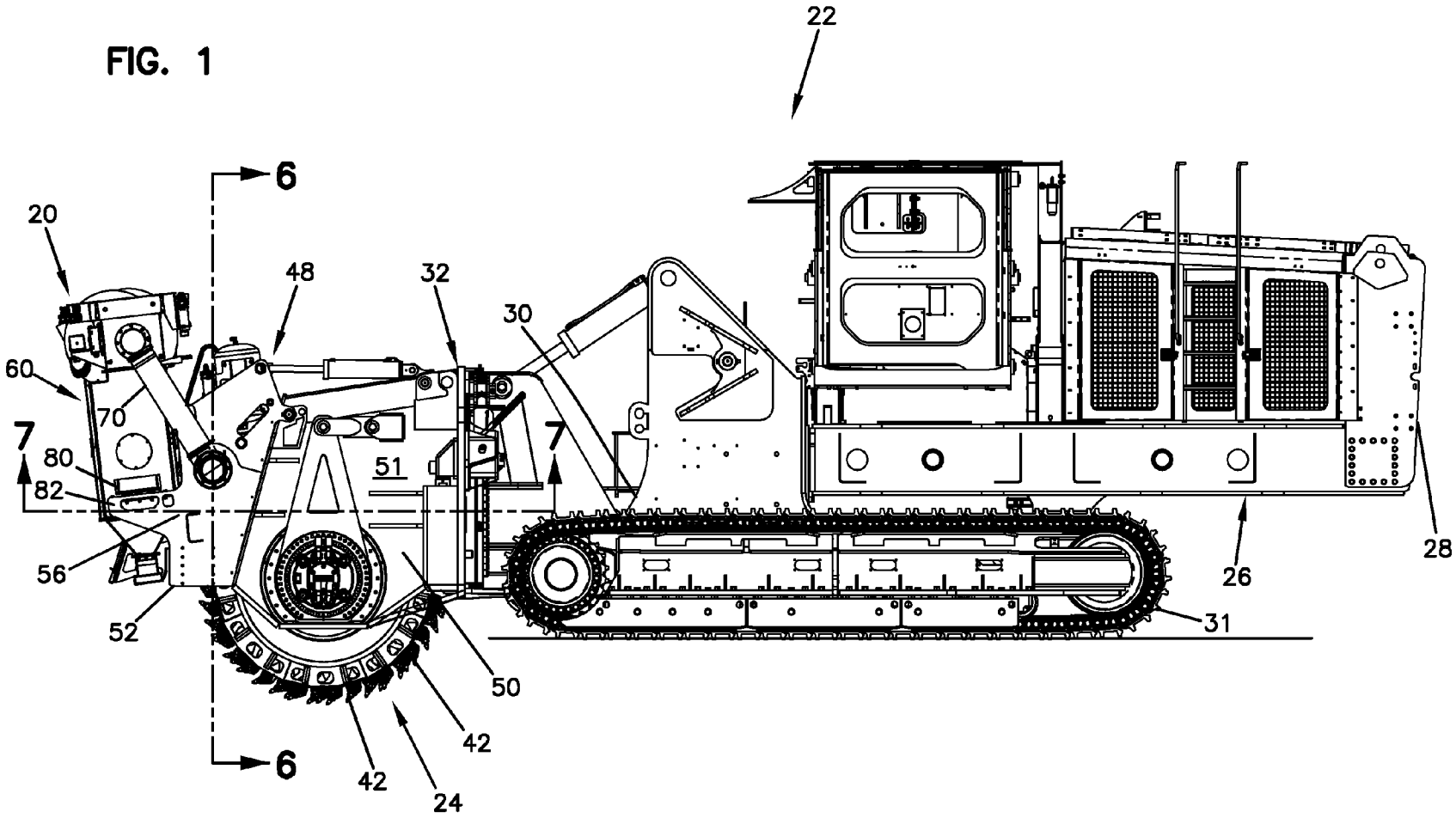
FIG. 1 is a side view of a surface mining machine including a first local dust extraction system in accordance with the principles of the present disclosure, the local dust extraction system includes a shroud with a pivotal portion shown in a closed position.

The present disclosure relates generally to local dust extraction systems for use on off-road excavation equipment. FIG. 1 shows a first local dust extraction system 20 on a piece of off-road excavation equipment in the form of a surface mining machine 22. During excavation operations using the surface mining machine 22, the local dust extraction system 20 captures dust generated by a cutting drum 24 (i.e., an excavation drum) of the surface mining machine 22 thereby reducing the amount of dust that is emitted/discharged to atmosphere. The dust is extracted from a localized volume surrounding the cutting drum 24. The localized volume is confined/defined by a shroud assembly 48 that encloses/covers at least a portion of the cutting drum 24.

It will be appreciated that the shroud can include various sealing structures for controlling or restricting the flow of outside air into the localized volume. Example sealing structures are disclosed at PCT/US2010/026363, which is hereby incorporated by reference in its entirety.

Referring still to FIG. 1, the surface mining machine 22 includes a chassis 26 having a front end 28 positioned opposite from a rear end 30. A boom 32 is attached to the rear end 30 of the chassis 26 at a pivot location 34 that allows the boom to be raised and lowered relative to the chassis 26. For example, the pivot location 34 can define a pivot axis 36 about which the boom 32 can be pivoted between an upper, non-excavating orientation (shown at FIG. 2) and a lower/excavating position (see FIGS. 1 and 3). The boom 32 projects rearwardly from the rear end 30 of the chassis 26. The chassis 26 is supported on a propulsion system including propulsion structures such as tracks 31.

The cutting drum 24 is rotatably mounted at a rear, free end of the boom 32. The cutting drum 24 includes a generally cylindrical face to which a plurality of cutting teeth 42 are attached. During excavation, the boom 32 is moved to the excavating position of FIG. 2 while the cutting drum 24 is concurrently rotated about a central axis 44 of the cutting drum. The central axis 44 extends across the width of the chassis 26. In certain embodiments, the cutting drum 24 can be rotated about the central axis 44 by a direct hydraulic drive arrangement including hydraulic motors mounted at opposite ends of the drum 24. The cutting drum 24 is preferably rotated in a direction 46 about the central axis 44 during excavation operations. The cutting drum 24 has a length that extends across at least a majority of the width of the chassis 26.

Figure 2:
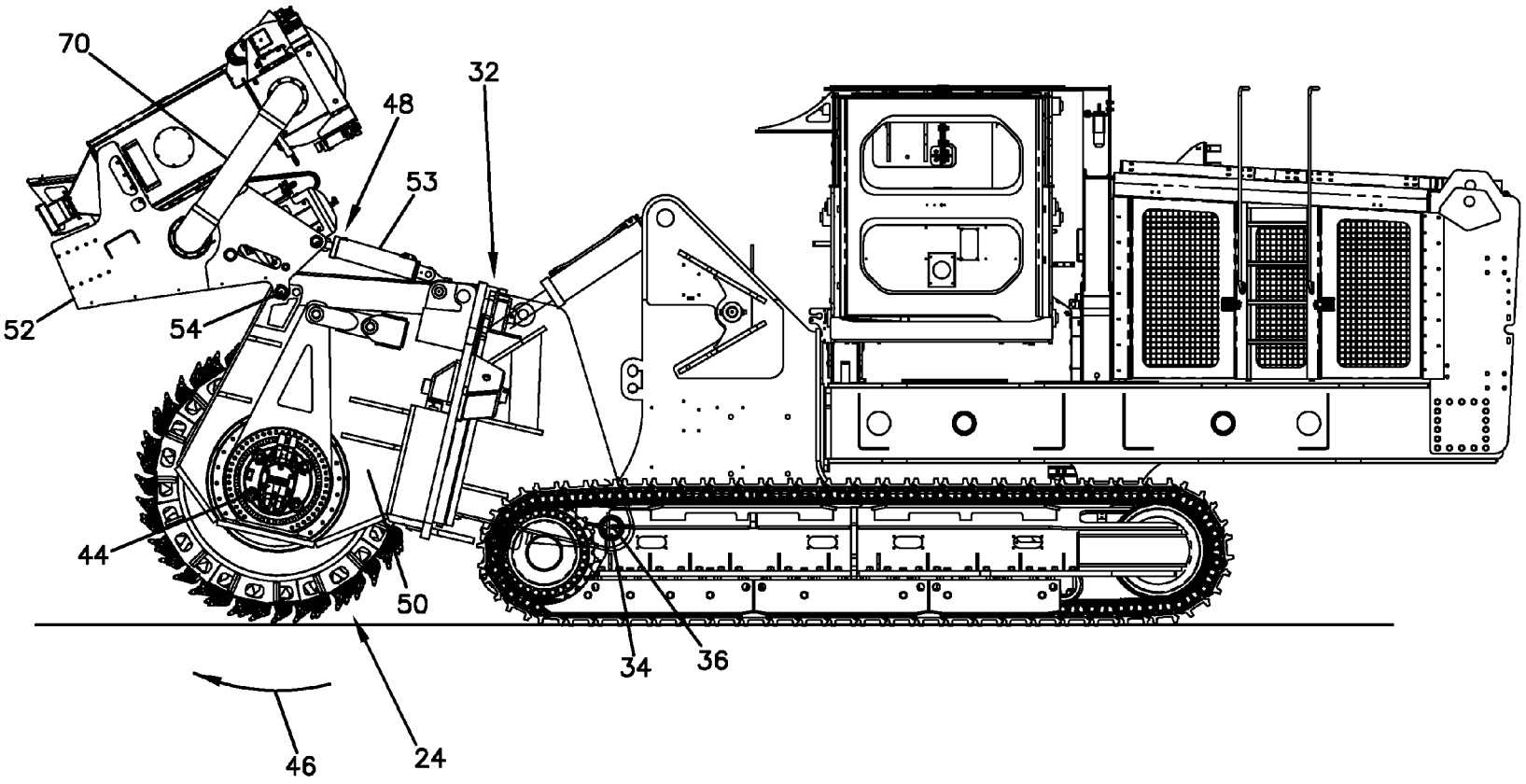
FIG. 2 is a side view of the surface mining machine of FIG. 1 showing with the pivotal portion of the shroud of the first local dust extraction system in an open position.

In use of the surface mining machine 22, the surface mining machine 22 is moved to a desired excavation site while the boom 32 is in the upper orientation of FIG. 2. When it is desired to excavate at the excavation site, the excavation boom 32 is lowered from the upper position to the lower position (see FIG. 3). While in the lower position, the drum 24 is rotated in the direction 46 about the axis 44 such that the drum 24 utilizes a down-cut motion to remove a desired thickness T of material (see FIG. 3). As the machine 22 moves in a forward direction 47, excavated material passes under the drum 24 and is left behind the machine 22. Preferably, the material left behind the drum 24 has a generally uniform consistency. During the excavation process, the tracks 31 propel the machine 22 in the forward direction 47 thereby causing a top layer of material having the thickness T to be excavated.

Figure 7:
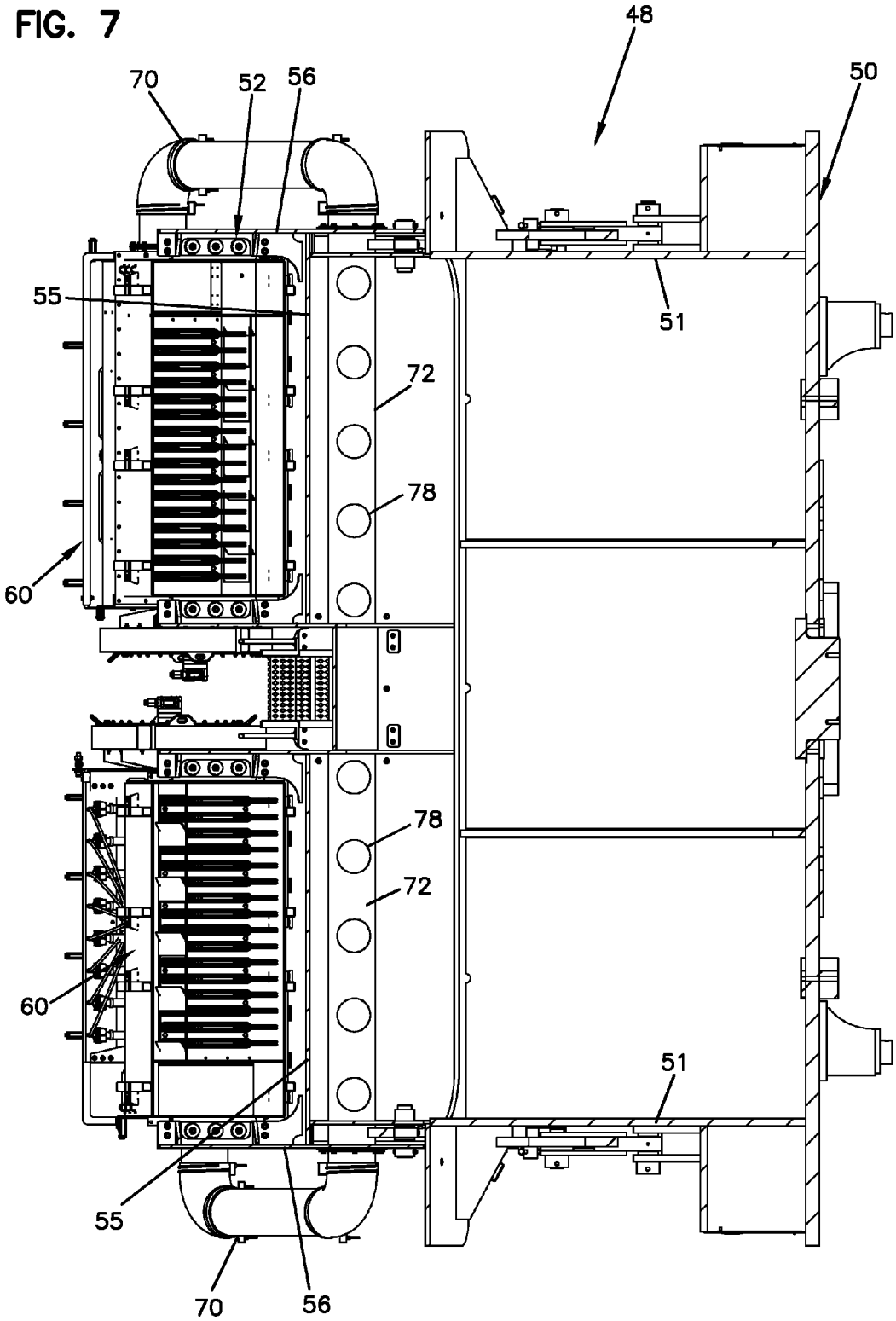
FIG. 7 is a bottom cross-sectional view taken along section line 7-7 of FIG. 1, the view shows the intake portion of the first local dust extraction system.

The shroud assembly 48 of the first localized dust extraction system 20 is carried by the boom 32. The shroud assembly 48 includes a fixed shroud component 50 secured to the boom 32 at a location directly over the cutting drum 24. The fixed shroud component 50 has a length that extends generally along the entire length of the cutting drum 24. The fixed shroud component 50 also includes end walls 51 (see FIG. 7) that oppose opposite axial ends of the drum 24. Hydraulic motors for rotating the drum about the axis 44 can be provided adjacent the end walls 51. The shroud assembly 48 also includes a rear movable shroud component 52 that is pivotally movable relative to the boom 32 and the fixed shroud component 50. The movable shroud component 52 can be pivoted about a pivot axis 54 relative to the fixed shroud component 50 between various positions. For example, the movable shroud component 52 can be moved to a raised position (shown at FIG. 2), and a lowered position (shown at FIG. 1). The pivot axis 54 is generally parallel to the central axis 44 of the cutting drum 24. With the movable shroud component 52 in the lowered position, the movable shroud component 52 cooperates with the fixed shroud component 50 to define the localized dust extraction volume around the drum 24. When the movable shroud component 52 is in the raised position, the drum 24 can be readily accessed. An actuator 53 (e.g., a hydraulic cylinder) is provided for moving the moveable shroud component 52 between the raised and lowered positions. It is preferred for the fixed shroud component 50 and the movable shroud component 52 to have a generally rigid, robust construction. In certain embodiments, such a rigid, robust construction can be provided by materials such as reinforced sheet metal.

The moveable shroud component 52 includes a rear wall 55 (see FIGS. 7, 11, 14 and 15) having a length that extends long the entire length of the cutting drum 24. The moveable shroud component 52 also includes end walls 56 positioned at opposite ends of the rear wall 55. The end walls 56 project forwardly from the rear wall 55 and align generally with the end walls 51 of the fixed shroud component 50. The end walls 56 cooperate with the rear wall 55 to define an interior volume in which a rear, upper portion of the drum 24 is received when the moveable shroud component 52 is in the lowered position. When the moveable shroud component 52 is in the lowered position, the end walls 56 at least partially oppose/cover the ends of the drum 24 and cooperate with the end walls 51 of the fixed shroud component 50 to enclose the ends of the localized dust extraction volume surrounding the drum 24.

The local dust extraction system 20 also includes two air cleaning units 60 (e.g., filtration units) that are mounted to the moveable shroud component 52 and that are carried by the moveable shroud component 52 as the moveable shroud component 52 is moved relative to the fixed shroud component 50 between the raised and lowered positions. The air cleaning units 60 include air cleaning housings 62 (i.e., filter enclosures, filter cabinets, bag housings) in which air cleaners 64 (e.g., bag filters, pleated filters, cyclone style dust separators) (see FIG. 9) are housed. The air cleaning units 60 also include sources of vacuum 66 (e.g., air moving devices such as fans or blowers) (see FIG. 9) for drawing air through the air cleaners 64.

The sources of vacuum 66 create negative pressure (i.e., pressure below atmospheric pressure) that continuously draws dust laden air from within the local dust extraction volume of the shroud assembly 48 and carries the dust laden air to the air cleaners 64. Vacuum generated negative pressure within the local dust extraction volume causes outside air to be drawn inwardly into the shroud assembly from a perimeter of the shroud thereby preventing dust generated by the cutting drum 24 from escaping from the perimeter of the shroud assembly 48. Dust within the air drawn from the shroud assembly 48 is removed from the air by the air cleaner 64.

Figure 8B:
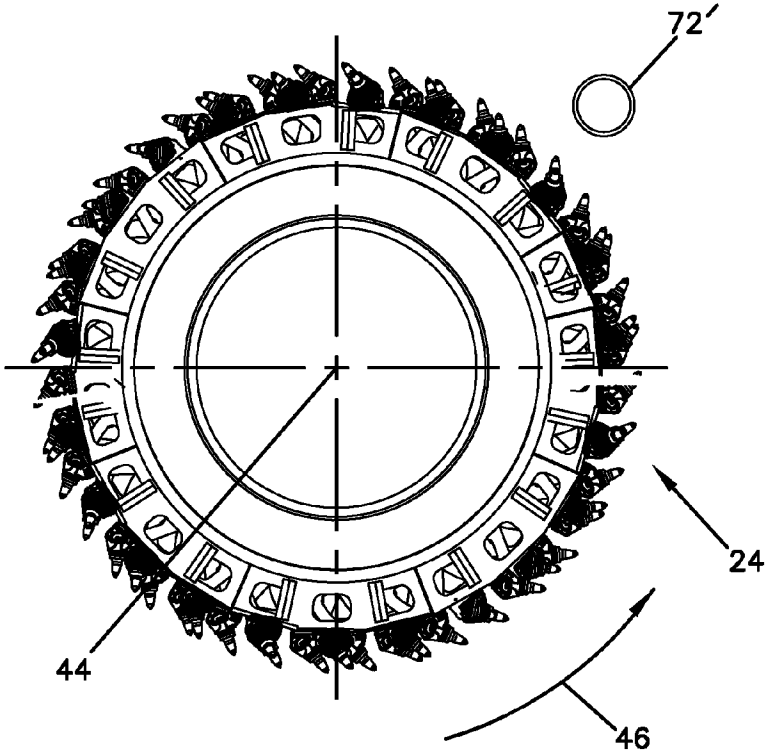
FIG. 8B schematically shows a position of the intake portion of the second local dust extraction system with respect to the excavation drum of the surface mining machine.
Figure 8A:
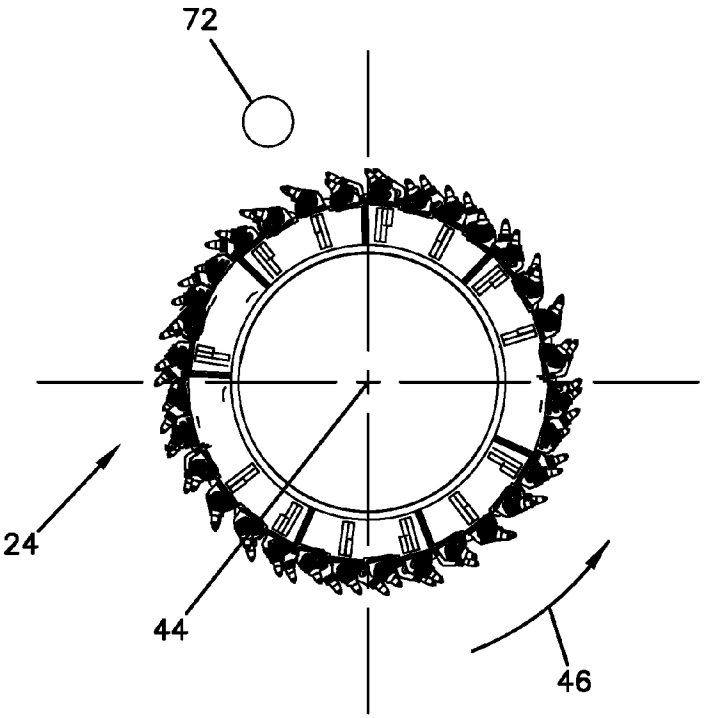
FIG. 8A schematically shows a position of the intake portion of the first local dust extraction system with respect to the excavation drum of the surface mining machine.
Figure 9:
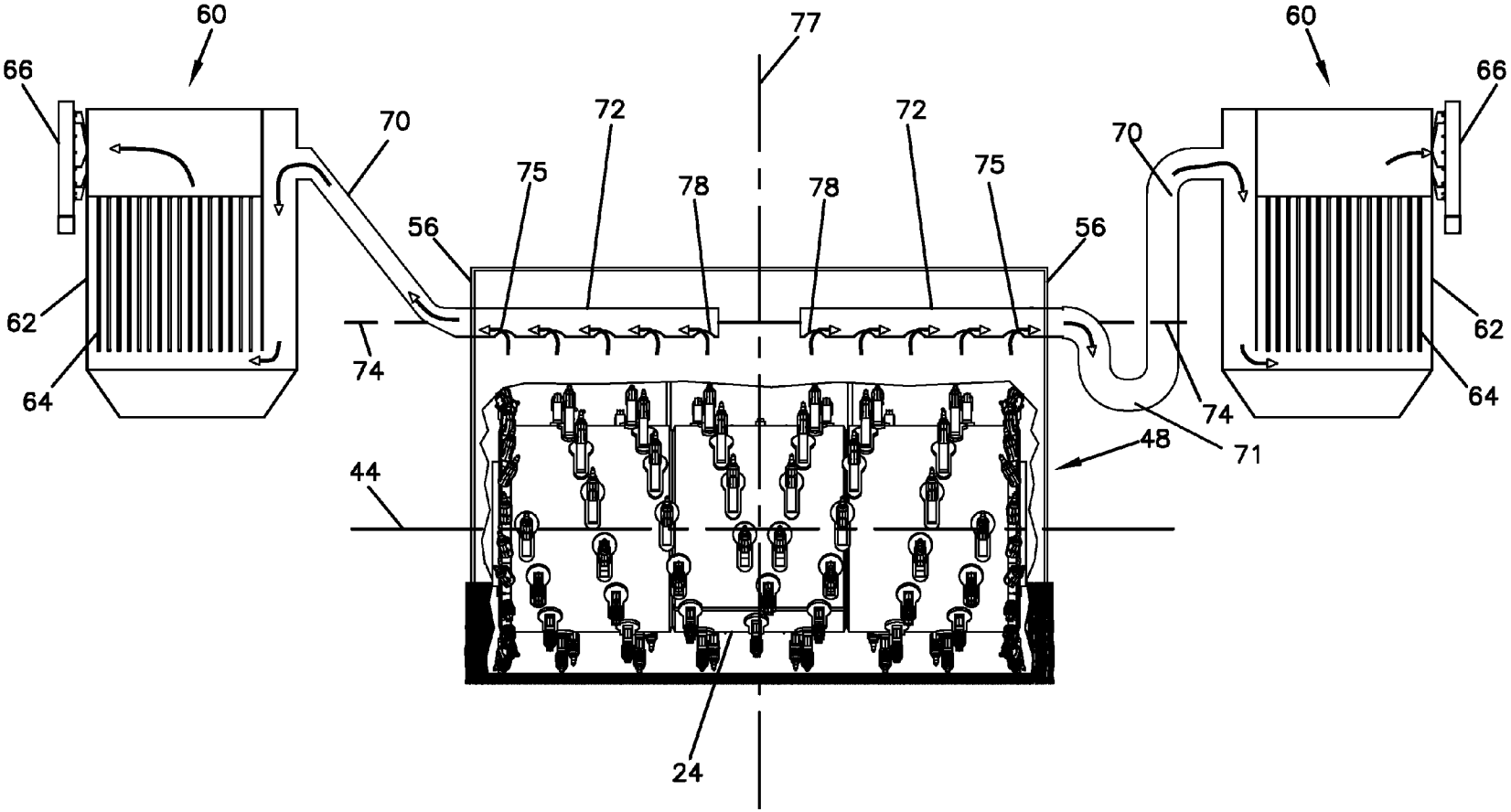
FIG. 9 is a schematic diagram showing air flow paths for the first local dust extraction system.
Figure 10:
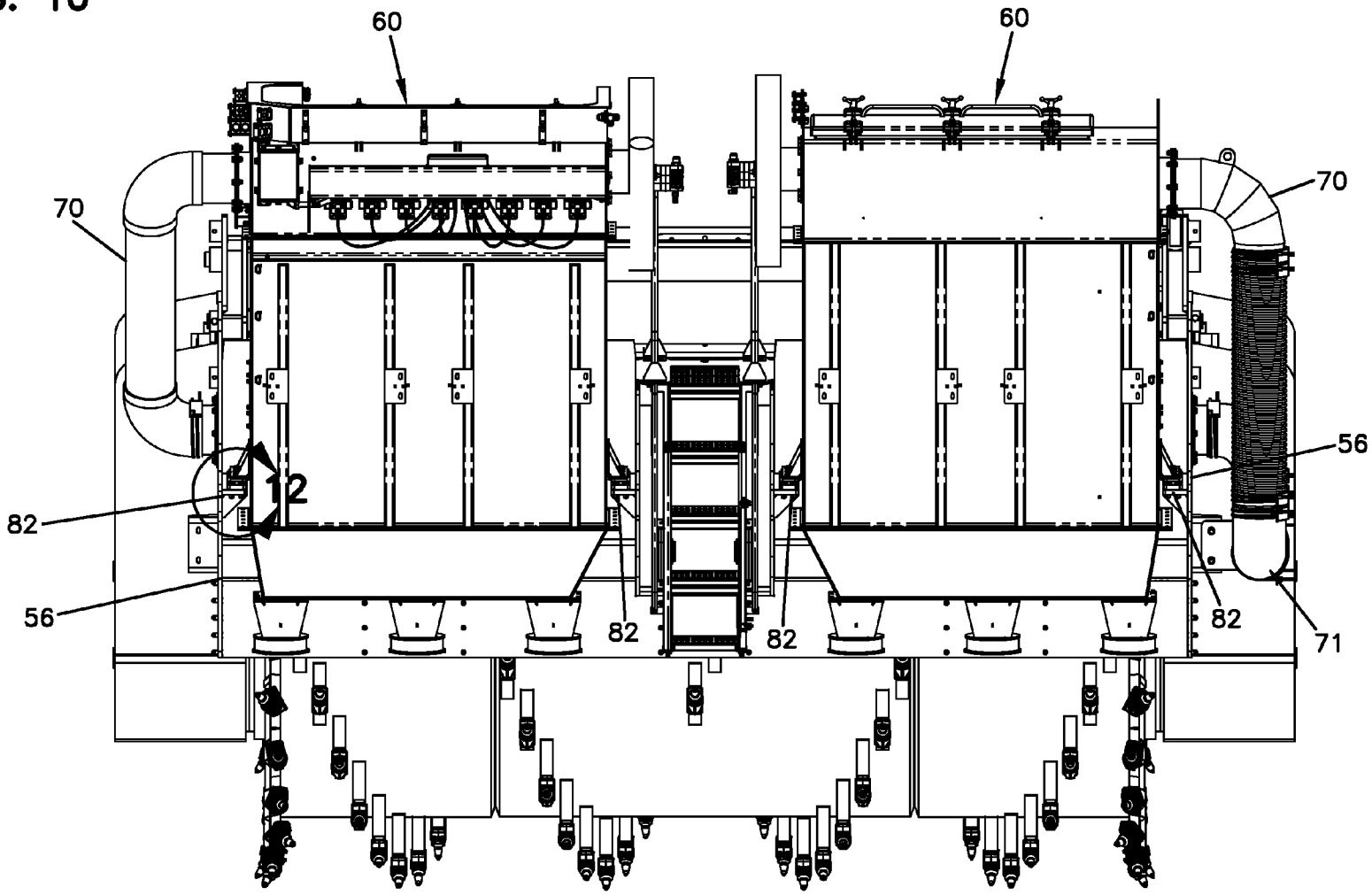
FIG. 10 is a rear view of the first local dust extraction system.
Figure 11:
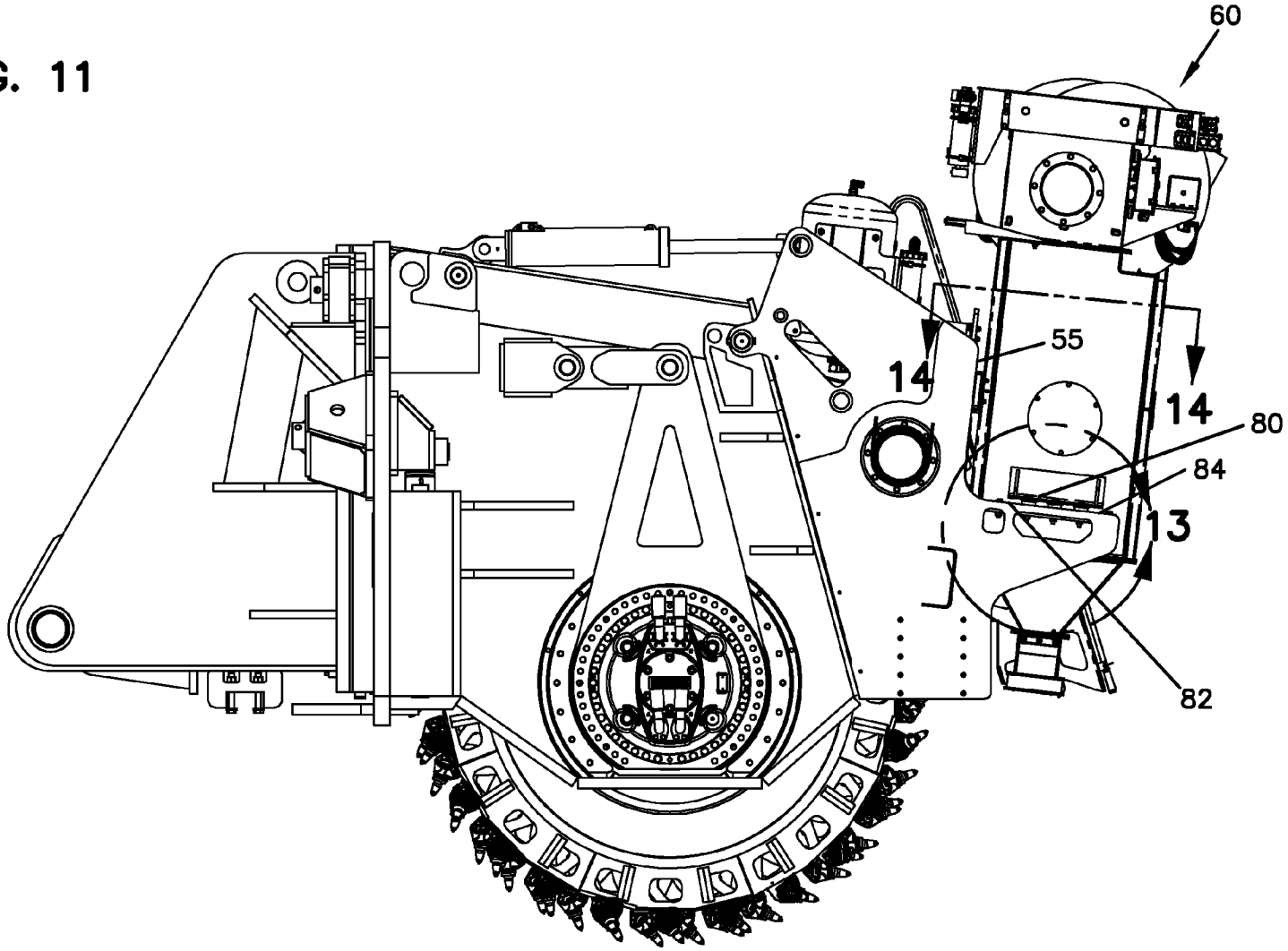
FIG. 11 is a side view of the first local dust extraction system.

The air cleaning housings 62 are fluidly connected to the local dust collection volume defined by the shroud assembly 48 by a low-velocity transport system. The low-velocity transport system includes first conduits 70 (e.g., pipes, hoses, etc.) that extend from the air cleaning housings 62 through the end walls 56 of the moveable shroud component 52 to air intake structures 72 (e.g., air intake manifolds) positioned within the interior volume defined by the moveable shroud component 52. In certain embodiments, the conduits 70 can include optional elbows or bends 71 (see FIG. 9) for collecting moisture entrained in the air pulled from the local dust extraction volume. The air intake structures 72 are depicted as elongated pipes having lengths that extend along axes 74. The axes 74 of each of the air intake structures 72 are co-axial and generally parallel to the axis 44 of the drum 24. A gap 76 is provided between inner ends of the air intake structures 72. Each of the air intake structures 72 defines a plurality of air intake openings 78 that are spaced-apart along the axes 74. In certain embodiments, at least 3, 4 or 5 openings 78 are defined by each of the air intake structures 72. The openings 78 face in a downward direction toward the drum 24 (see FIGS. 7 and 9). As shown at FIG. 8A, the air intake structures 72 are spaced upwardly and forwardly with respect to the axis 44 of the drum 24. In one embodiment, the air intake structures 72 can be located at a circumferential position relative to the drum 24 that is between the twelve o'clock and nine o'clock clock position relative to the central axis 44 of the drum 24. As shown at FIG. 9, air flow through the air intake structures 72 is along directions 75 that extend away from a central vertical plane 77 that bisects the drum 24 and is perpendicular to the axis 44 of the drum 24.

In certain embodiments, the local dust extraction system is designed such that the speed of the air traveling through the conduits 70 is between 1000 and 1800 feet per minute and that flow the speed of the air entering the air intake structures 72 is less than 500 feet per minute. In certain embodiments, the speed of the air in the conduits 70 is at least twice as fast as the speed of the air entering the air intake structures 72 through the openings 78. This can be achieved by providing the combined cross-sectional flow areas of the openings 78 in each intake structure 72 larger than the cross-sectional flow area of the corresponding conduit 70. In one embodiment, the cutting drum 24 has a length of at least 12 feet and a diameter of 68 inches, the shroud assembly 48 defines an outer perimeter length of about 144 feet when in the lowered orientation, and each source of vacuum 66 provides an air flow rate of at least 2500 cubic feet per minute. Thus, a vacuum air flow rate of at least 416 cubic feet per minute per each foot of cutting drum is provided to the shroud assembly 48 by the vacuum sources.

Figure 13:
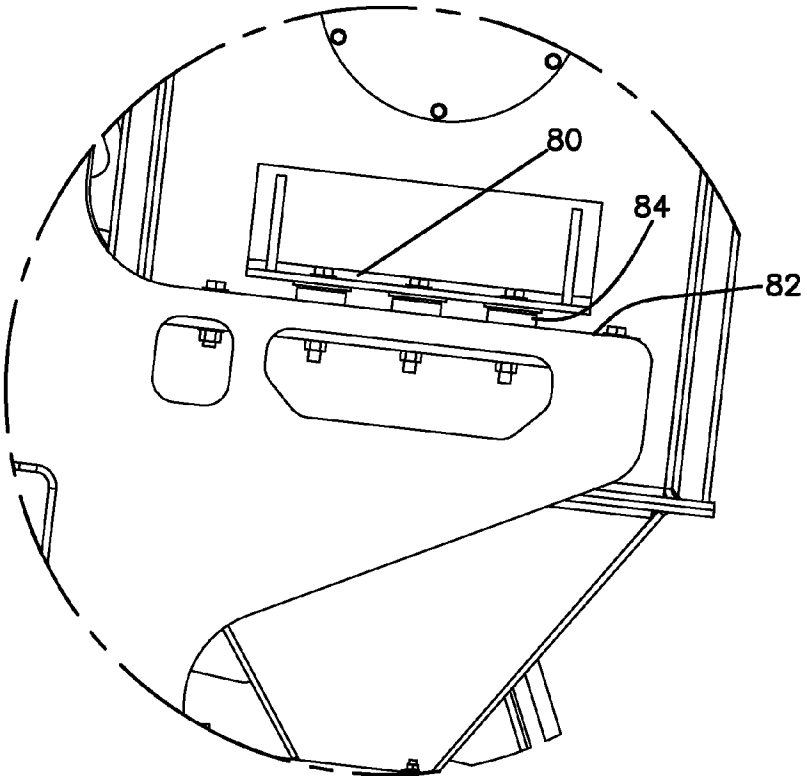
FIG. 13 is an enlarged view of a portion of FIG. 11, the view shows a side the vertical isolator arrangement for isolating the filter housing of the first local dust extraction system.
Figure 12:
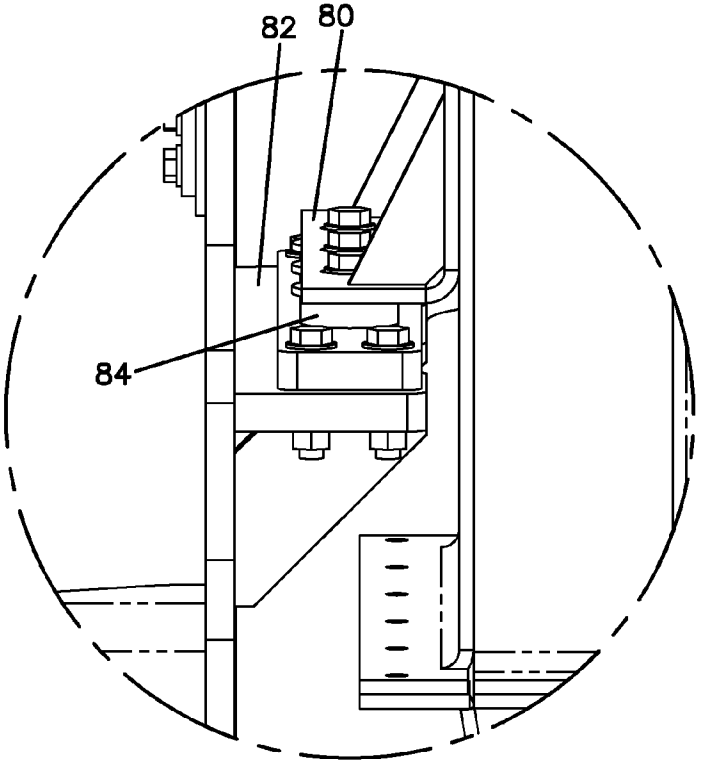
FIG. 12 is an enlarged view of a portion of FIG. 10, the view shows a rear of a vertical isolator arrangement for isolating a filter housing of the first local dust extraction system.
Figure 14:
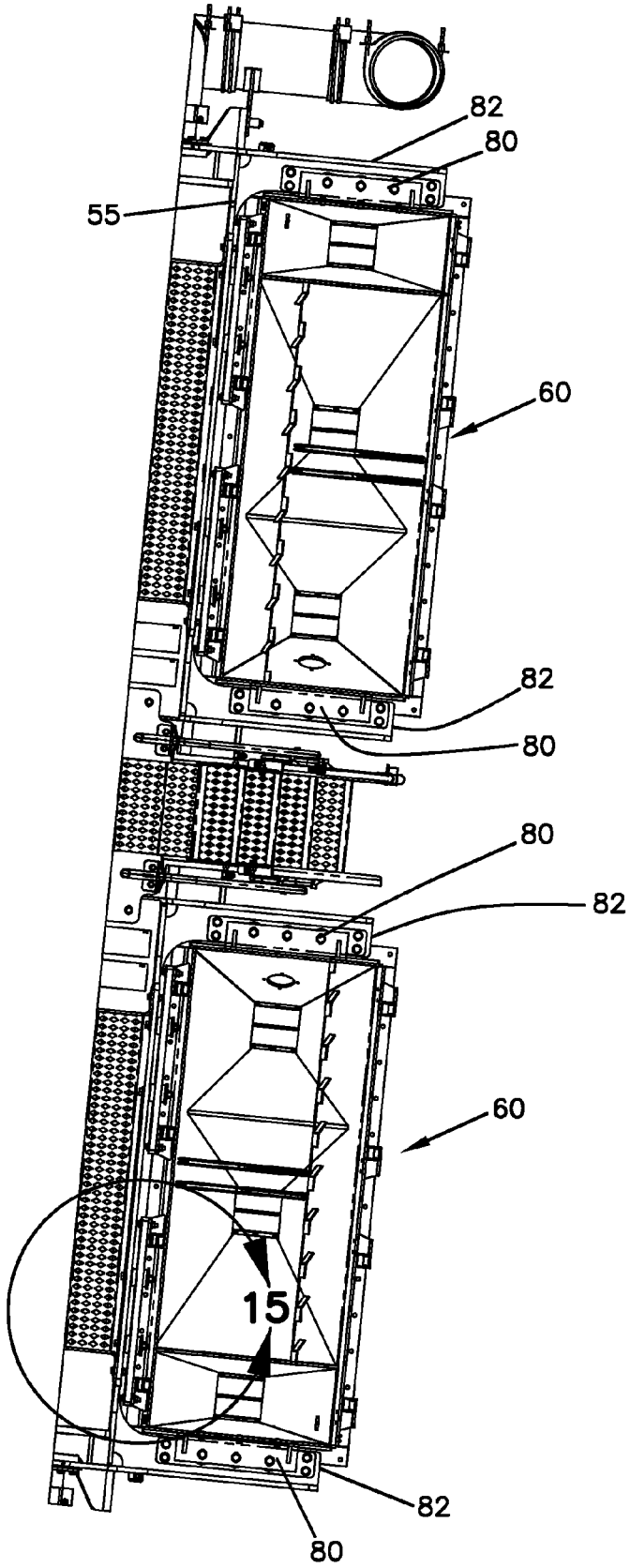
FIG. 14 is a top cross-sectional view taken along section line 14-14 of FIG. 11.
Figure 15:
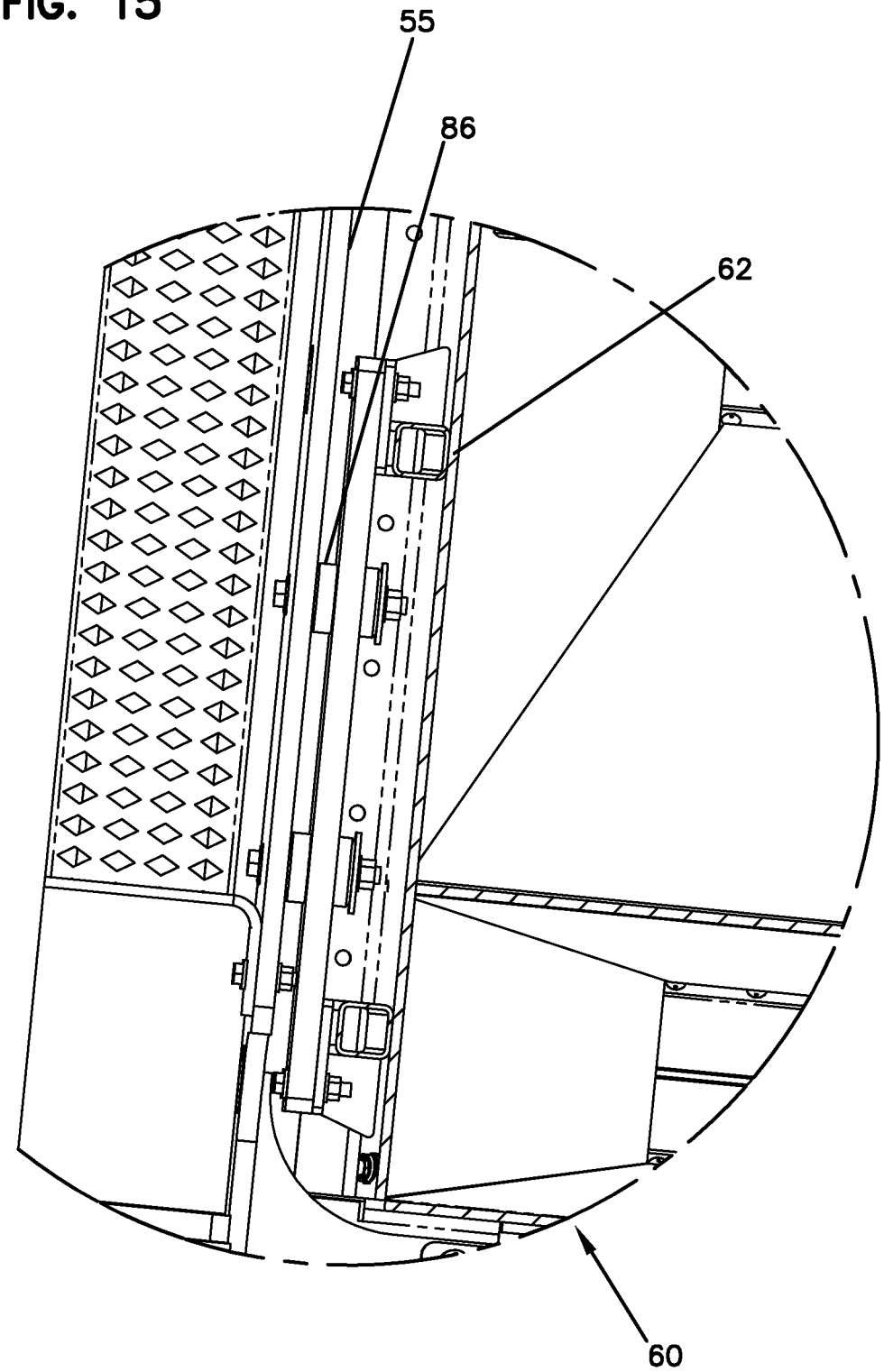
FIG. 15 is an enlarged view of a portion of FIG. 14, the view shows a top of a horizontal isolator arrangement for isolating the filter housing of the first local dust extraction system.

As shown at FIGS. 1, 2, 10 and 11, the air cleaning units 60 are mounted to the outside of the rear wall 55 of the moveable shroud component 52. For example, mounting flanges 80 are secured to opposite sides of each air cleaning housing 62. The mounting flanges 80 are supported on mounting shelves 82 that project rearwardly from the rear wall 55. The mounting shelves 82 straddle each of the air cleaning housings 62. Isolators (e.g., vibration and shock isolators) such as elastomeric dampeners 84 (see FIGS. 12 and 13) can be mounted between the mounting flanges 80 and the shelves 82 to provided vibration dampening and/or protection in a vertical orientation. Isolators (e.g., vibration and shock isolators) such as elastomeric dampeners 86 (see FIGS. 14 and 15) can be mounted between the rear wall 55 and the air cleaner housings 62 to provide vibration and/or shock protection in a horizontal orientation. In certain embodiments, the isolators can have a natural frequency in the range of 8-18 Hertz.

In use of the machine 22, the boom 32 is lowered to place the drum 24 at a desired cutting depth while the drum is concurrently rotated in the direction 46 about the central axis 44 of the drum 24. The machine 22 is then moved in a forward direction thereby causing the cutting drum 24 to excavate a layer of material having a width equal to the length of the cutting drum 24. As this excavation takes place, the shroud assembly 48 is positioned in the lower position so as to enclosure the local dust extraction volume around the drum 24, and the sources of vacuum 66 concurrently draw air from within the shroud assembly 48 thereby providing a negative pressure within the shroud assembly 48. The negative pressure provided by sources of vacuum 66 causes air to be drawn through from outside the local dust extraction volume to replace the air that is drawn from the interior of the shroud assembly through the conduits 70 to the air cleaners 60. As air is drawn from the shroud assembly 48 through the air intakes 72 and into the conduits 70, dust generated by the cutting drum 24 is carried by the air flow out of the shroud assembly through the conduits 70 to the air cleaners 60. The dust is filtered or otherwise removed from the air stream within the air cleaners 60. After having been removed from the air stream, the dust can be collected in a container or deposited on the ground.

Figure 3:
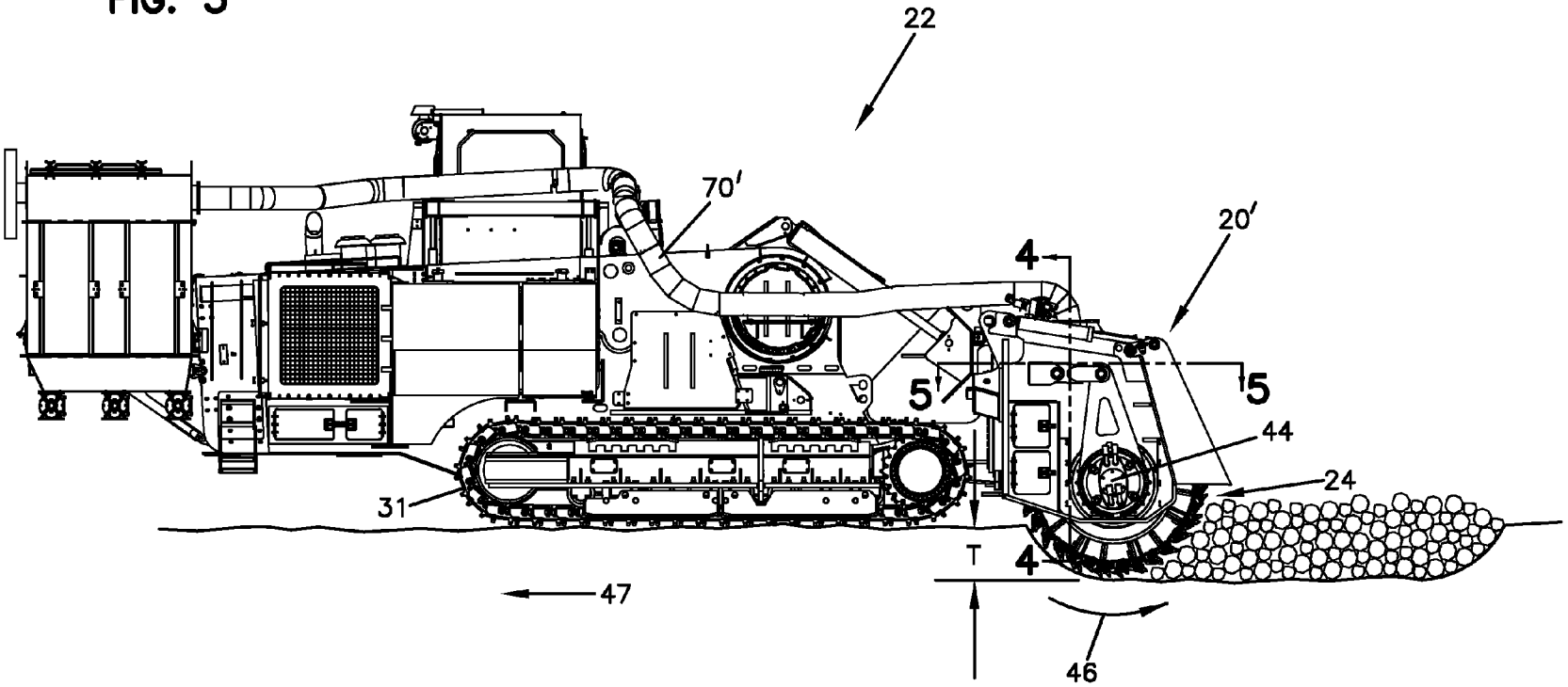
FIG. 3 is a side view of surface mining machine of FIG. 1 showing a second local dust extraction system in accordance with the principles of the present disclosure.
Figure 4:
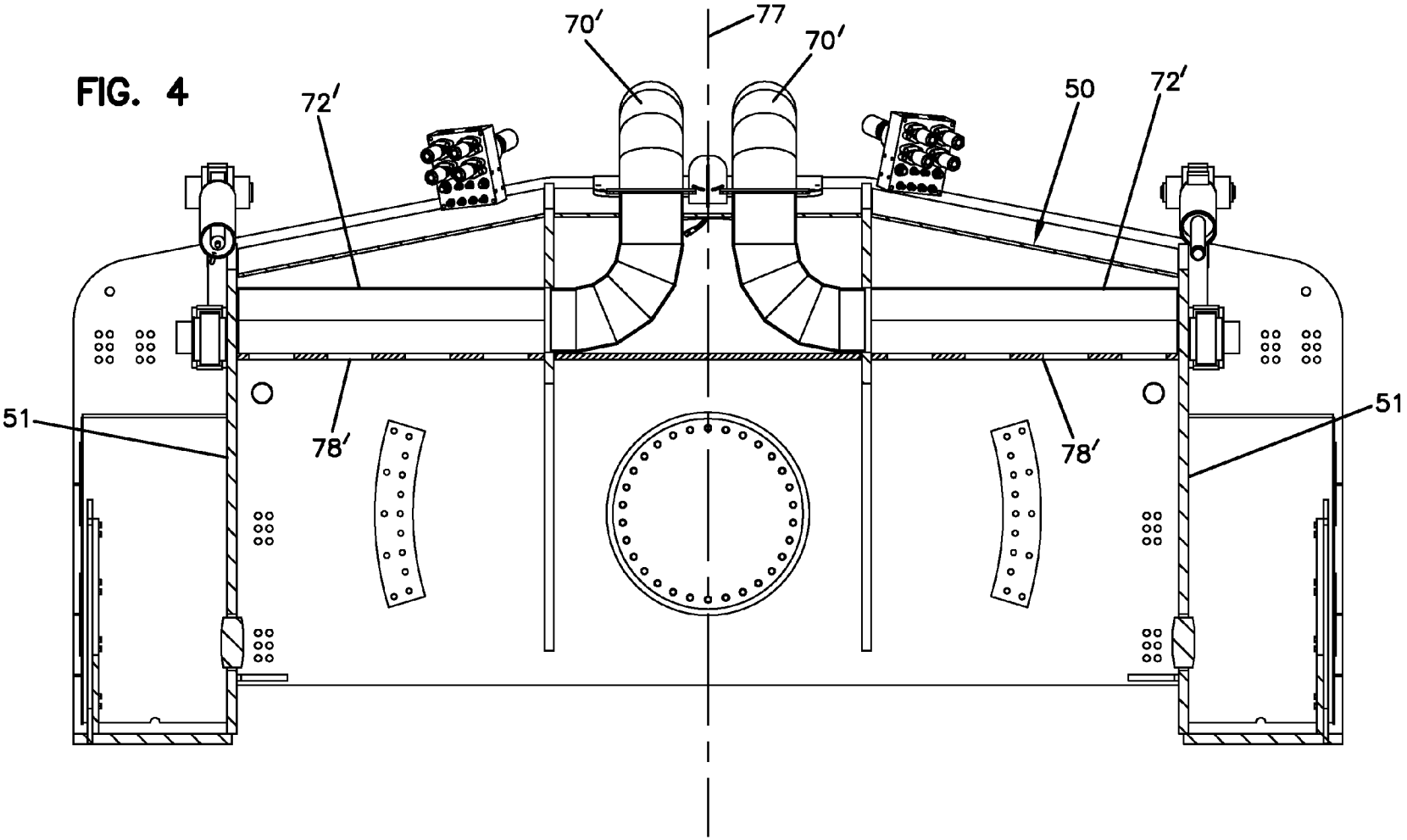
FIG. 4 is a rear cross-sectional view taken along section line 4-4 of FIG. 3, the view shows an intake portion of the second local dust extraction system.
Figure 5:
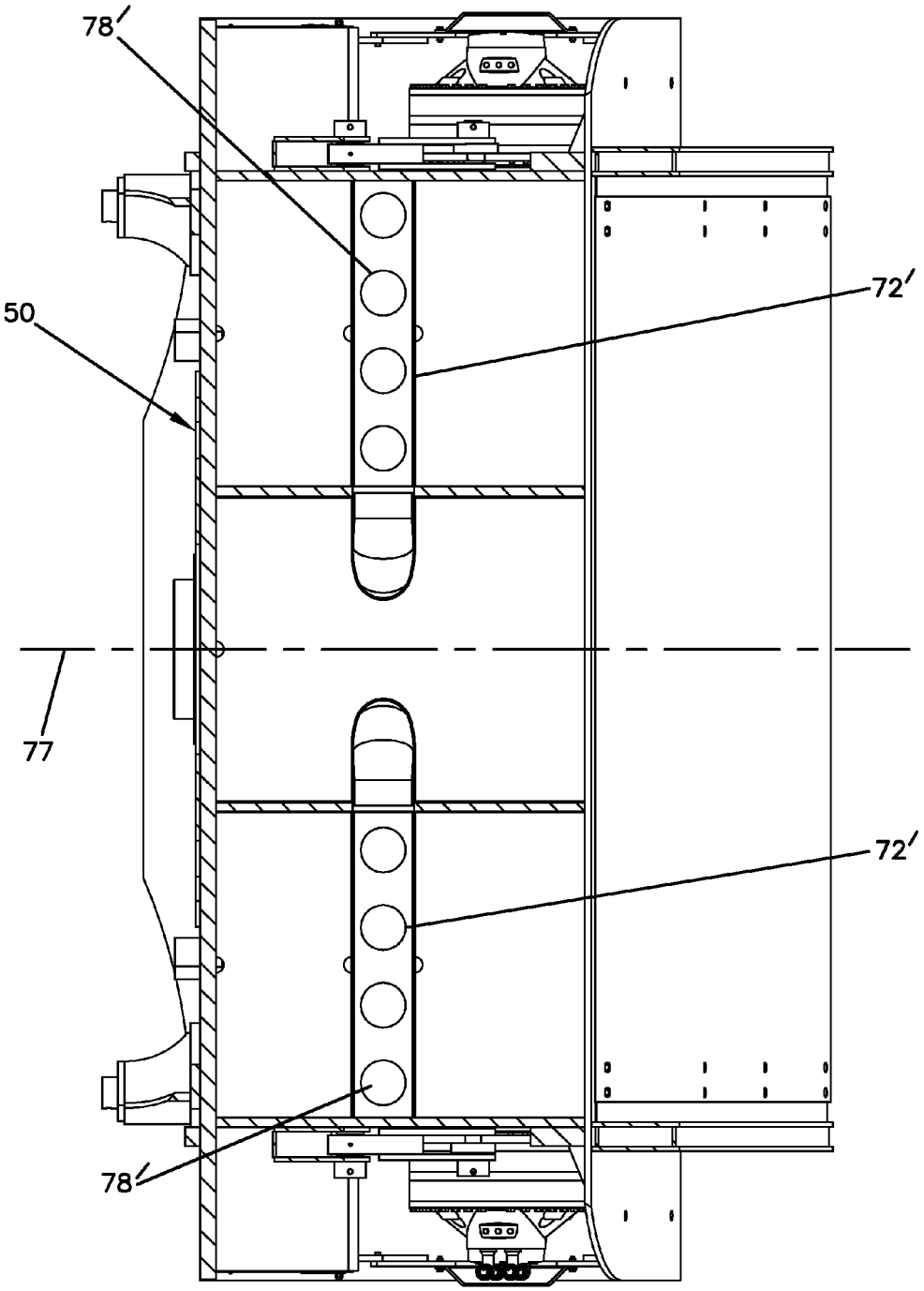
FIG. 5 is a bottom cross-sectional view taken along section line 5-5 of FIG. 3, the view shows the intake portion of the second local dust extraction system.
Figure 6:
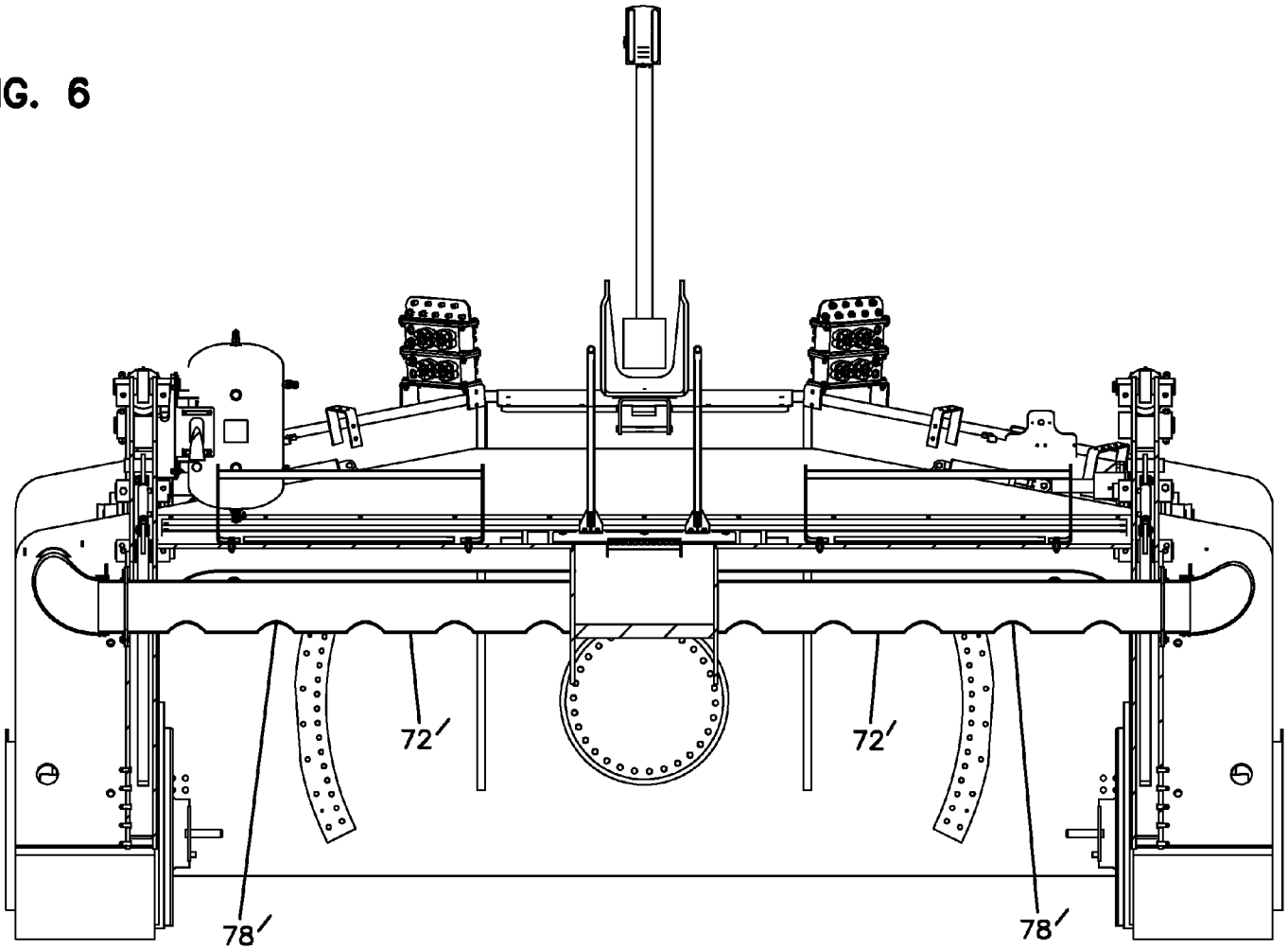
FIG. 6 is a rear cross-sectional view taken along section line 6-6 of FIG. 1, the view shows an intake portion of the first local dust extraction system.

FIGS. 3-5 show the surface excavation machine 22 equipped with a second local dust extraction system 20' in accordance with the principles of the present disclosure. The system 20' has many of the same components as the system 20, except the components are arranged in a different configuration. For example, air cleaners 60 are mounted to the chassis 26 of the machine 22 adjacent the front end 28 of the machine 22. Also, conduits 70' are routed along the length of the machine 22 and carry dust laden air from the local dust extraction volume defined by the shroud assembly 48 from the rear end of the machine to the air cleaning units 60 at the front of the machine 22. Also, the system 20' includes air intakes 72' secured to the fixed shroud component 50. The air intakes 72' are parallel to the axis 44 of the drum 24 and are positioned inside the interior of the shroud assembly 48 within the local dust extraction volume defined by the shroud assembly 48. The intakes 72' define openings 78'. As shown at FIG. 8B, the air intakes 72' are located between the twelve o'clock and three o'clock clock positions relative to the central axis 44 of the drum 24. The conduits 70 connect to the air intakes 72' at a central location of the shroud assembly 48 near the central plane 77 of the drum 24. Air is drawn through the air intakes 72' in directions toward the central plane 77.

The invention claimed is:

1. A system for capturing dust generated by an excavation component carrying a plurality of cutting teeth, the excavation component being rotatable about a central axis of the excavation component, the system comprising:

a shroud for at least partially covering the excavation component, the shroud defining a local dust extraction volume; and a first intake conduit positioned within the local dust extraction volume between the shroud and the excavation component, the first intake conduit defining a length that extends from an air evacuation end to an opposite distal end, wherein a vacuum is attached at the air evacuation end of the first intake conduit, the first intake conduit defining a plurality of air intake openings that are spaced-apart along the length of the first intake conduit between the air evacuation end and the opposite distal end.

2. The system of claim 1, further comprising a second intake conduit positioned within the local dust extraction volume between the shroud and the excavation component, the second intake conduit defining a plurality of air intake openings that are spaced-apart along a length of the second intake conduit.

3. The system of claim 2, wherein the first and second intake conduits are co-axially aligned.

4. The system of claim 2, wherein the first and second intake conduits are generally parallel to the central axis of the component.

5. The system of claim 2, wherein the excavation component is bisected by a central plane that is perpendicular relative to the central axis of the excavation component, and wherein the first and second intake conduits carry air in directions away from the central plane.

6. The system of claim 2, wherein the excavation component is bisected by a central plane that is perpendicular relative to the central axis of the excavation component, and wherein the first and second intake conduits carry air in directions toward the central plane.

7. The system of claim 1, wherein the excavation component rotates in a clockwise direction, and wherein the first intake conduit is positioned directly above the central axis of the excavation component.

8. The system of claim 1, wherein the excavation component rotates in a clockwise direction, and wherein the first intake conduit is positioned directly above the central axis of the excavation component.

9. The system of claim 1, wherein the excavation component is an excavation drum.

10. The system of claim 1, wherein the first intake conduit extends proximal to the excavation component.

11. The system of claim 1, wherein the first intake conduit has a conduit axis, the first intake conduit extending such that the conduit axis is generally parallel to the central axis of the excavation component.

12. The system of claim 1, wherein the plurality of air intake openings is facing in a direction toward the excavation component.

13. The system of claim 1, wherein the plurality of air intake openings together define a combined cross-sectional intake flow area and the first intake conduit defines a conduit cross-sectional flow area, and wherein the combined cross-sectional intake flow area is larger than the conduit cross-sectional flow area.

14. A system for capturing dust generated by an excavation component carrying a plurality of cutting teeth, the excavation component being rotatable about a central axis of the excavation component, the system comprising:

a shroud assembly at least partially covering the excavation component, the shroud assembly including a first shroud component and a second shroud component, the first shroud component being movable relative to the second shroud component between a first position where the excavation component is accessed and a second position where the first and second shroud components cooperate to define a local dust extraction volume; and a first intake conduit positioned within the first shroud component, the first intake conduit being carried with the first shroud component such that when the first shroud component is raised, the first intake conduit is displaced relative to the excavation component;

wherein the first intake conduit defines a length that extends from an air evacuation end to an opposite closed end, the first intake conduit defining a plurality of air intake openings that are spaced-apart along the length of the first intake conduit.

15. The system of claim 14, wherein the first intake conduit is cylindrical in shape.

16. A system for capturing dust generated by an excavation component carrying a plurality of cutting teeth, the excavation component being rotatable about a central axis of the excavation component, the system comprising:

a shroud for at least partially covering the excavation component, the shroud defining a local dust extraction volume; and a first intake conduit positioned within an interior volume defined by the shroud, the first intake conduit defining a length that extends substantially parallel relative to an axis of rotation of the excavation component, the first intake conduit defining a plurality of air intake openings that are spaced-apart along the length of the first intake conduit and spaced-apart relative to the axis of rotation.

* * * * *